US009484684B2

(12) United States Patent
Tanikawa et al.

(10) Patent No.: US 9,484,684 B2
(45) Date of Patent: Nov. 1, 2016

(54) CONNECTOR WITH PERIPHERAL WALL HAVING AN OPENING AND A DETECTOR SLIDABLY ENGAGING THE PERIPHERAL WALL ADJACENT THE OPENING FOR PREVENTING WIDENING OF THE OPENING

(71) Applicant: Sumitomo Wiring Systems, Ltd., Yokkaichi, Mie (JP)

(72) Inventors: Naotaka Tanikawa, Mie (JP); Akira Nakashima, Mie (JP); Norihito Hashimoto, Mie (JP); Shigeto Kataoka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/787,344

(22) PCT Filed: May 8, 2013

(86) PCT No.: PCT/JP2013/062971
§ 371 (c)(1),
(2) Date: Oct. 27, 2015

(87) PCT Pub. No.: WO2014/181410
PCT Pub. Date: Nov. 13, 2014

(65) Prior Publication Data
US 2016/0064875 A1 Mar. 3, 2016

(51) Int. Cl.
*H01R 13/627* (2006.01)
*H01R 13/703* (2006.01)
(Continued)

(52) U.S. Cl.
CPC ..... *H01R 13/703* (2013.01); *H01R 13/6275* (2013.01); *H01R 13/639* (2013.01); *H01R 13/641* (2013.01)

(58) Field of Classification Search
CPC ..... H01R 13/6272; H01R 13/6275; H01R 13/641; H01R 13/4223; H01R 13/4362
USPC ..... 439/352, 357, 358, 489, 595, 752
See application file for complete search history.

(56) References Cited

U.S. PATENT DOCUMENTS 5,910,027 A * 6/1999 Wayt ..... H01R 13/641 439/352
6,109,956 A 8/2000 Kawase et al.
(Continued)

FOREIGN PATENT DOCUMENTS

JP 11-111390 4/1999
JP 2000082541 A 3/2000
(Continued)

OTHER PUBLICATIONS

International Search Report.
(Continued)

*Primary Examiner* — Thanh Tam Le
(74) *Attorney, Agent, or Firm* — Gerald H. Hespos; Michael J. Porco; Matthew T. Hespos

(57) ABSTRACT

A connector includes a first housing (10) with a terminal accommodating portion (11) surrounded by a peripheral wall (17), a second housing (60) connectable to the first housing (10), and a detector (40) to detect a connected state of the housings (10, 60) based on whether the detector (40) moves from an initial position to a detection position in a space between the terminal accommodating portion (11) and the peripheral wall (17). An opening (22) extends circumferentially in a part of the peripheral wall (17) and exposes the detector (40). Deformation regulating portions (23, 53) are formed on the peripheral wall (17) and the detector member (40) and permit movements of the detector (40) between the initial position and the detection position and regulate deformation of the peripheral wall (17) to enlarge an opening width of the opening (22) by being fit to each other.

7 Claims, 20 Drawing Sheets

(51) Int. Cl.
*H01R 13/639* (2006.01)
*H01R 13/641* (2006.01)

(56) References Cited

U.S. PATENT DOCUMENTS 6,196,867 B1 3/2001 Kawase et al.
6,208,237 B1 3/2001 Saiki et al.
6,261,116 B1 * 7/2001 Ceru ..... H01R 13/6272 439/352
6,435,895 B1 * 8/2002 Fink ..... H01R 13/6272 439/352
6,692,289 B2 * 2/2004 Nemoto ..... H01R 13/639 439/160
6,743,040 B1 * 6/2004 Nakamura ..... H01R 13/6272 439/352
6,780,045 B2 * 8/2004 Shuey ..... H01R 13/641 439/352
6,918,783 B2 * 7/2005 Endo ..... H01R 13/6272 439/352
7,114,983 B2 * 10/2006 Fukatsu ..... H01R 13/4223 439/358
7,326,074 B1 * 2/2008 Lim ..... H01R 13/629 439/352
8,628,344 B2 * 1/2014 Cole ..... H01R 13/6272 439/352
8,882,528 B2 * 11/2014 Sasho ..... H01R 13/6335 439/358
2002/0022393 A1 2/2002 Saka et al.
2004/0102075 A1 5/2004 Nakamura
2005/0054233 A1 3/2005 Nakamura
2008/0153343 A1 6/2008 Kobayashi et al.

FOREIGN PATENT DOCUMENTS

JP 2001-85111 3/2001
JP 2002-56933 2/2002
JP 3303782 5/2002
JP 2003-77590 3/2003
JP 2008-159504 7/2008

OTHER PUBLICATIONS

European Search Report Dated Mar. 17, 2016.

* cited by examiner

CONNECTOR WITH PERIPHERAL WALL HAVING AN OPENING AND A DETECTOR SLIDABLY ENGAGING THE PERIPHERAL WALL ADJACENT THE OPENING FOR PREVENTING WIDENING OF THE OPENING

BACKGROUND

1. Field of the Invention

The present invention relates to a connector.

2. Description of the Related Art

Japanese Patent No. 3303782 discloses a connector configured to detect a connected state of male and female housings based on whether or not a detecting member provided in the female housing moves to a detection position when a connecting operation of the two housings is finished.

The female housing includes a terminal accommodating portion and a peripheral wall portion surrounding the terminal accommodating portion, and the detecting member is accommodated in a space between the outer surface of the terminal accommodating portion and the inner surface of the peripheral wall portion. Thus, a dimension of the female housing is large in an arrangement direction of the terminal accommodating portion, the detecting member and the peripheral wall portion.

The present invention was completed based on the above situation and aims to miniaturize a housing provided with a detecting member.

SUMMARY

The present invention is directed to a connector including a first housing formed such that a terminal accommodating portion is surrounded by a peripheral wall, a second housing connectable to the first housing, a detecting member configured to detect a connected state of the first and second housings based on whether or not the detecting member moves from an initial position to a detection position in a space between the terminal accommodating portion and the peripheral wall, an opening formed by cutting a part of the peripheral wall in a circumferential direction and configured to expose the detecting member to an outer peripheral side, and deformation regulating portions formed on the peripheral wall and the detecting member and configured to permit movements of the detecting member between the initial position and the detecting position and regulate such deformation of the peripheral wall as to enlarge an opening width of the opening by being fitted to each other.

According to this configuration, the peripheral wall is not present at the outer peripheral side of the detecting member since the opening of the peripheral wall is open to expose the detecting member to the outer peripheral side. Thus, the first housing can be miniaturized as compared with the case where the peripheral wall is present at the outer peripheral side of the detecting member. Further, if the opening is formed on the peripheral wall, the peripheral wall may be deformed to change the opening width of the opening. However, in the present invention, the deformation of the peripheral wall is prevented by fitting the deformation regulating portion on the opening edge of the opening on the peripheral wall and the deformation regulating portion formed on the detecting member.

The connector may include a rib constituting the deformation regulating portion of the peripheral wall and may project to the outer peripheral side from an opening edge part of the opening. A groove may constitute the deformation regulating portion of the detecting member and may be configured to sandwich the rib substantially in the circumferential direction and sandwich the opening edge part of the opening and the rib substantially in a radial direction. According to this configuration, it is possible to regulate the widening and narrowing of the opening in the circumferential direction and, in addition, regulate a radial displacement of the detecting member relative to the peripheral wall.

A lock arm may be arranged between the terminal accommodating portion and the peripheral wall and may be configured to lock the first and second housings in the connected state. The detecting member and the lock arm may at least partly overlap in an arrangement direction of the terminal accommodating portion and the lock arm. According to this configuration, the first housing can be miniaturized since the detecting member and the lock arm at least partly overlap in the arrangement direction of the terminal accommodating portion and the lock arm.

DETAILED DESCRIPTION

Hereinafter, one specific embodiment of the present invention is described with reference to FIGS. 1 to 20. A connector of this embodiment includes a first housing 10 made of synthetic resin, a detecting member 40 made of synthetic resin and mounted on the first housing 10, spring members 56 made of metal and mounted in the first housing 10 and a second housing 60 made of synthetic resin.

<Configuration of First Housing 10>

Figure 1:
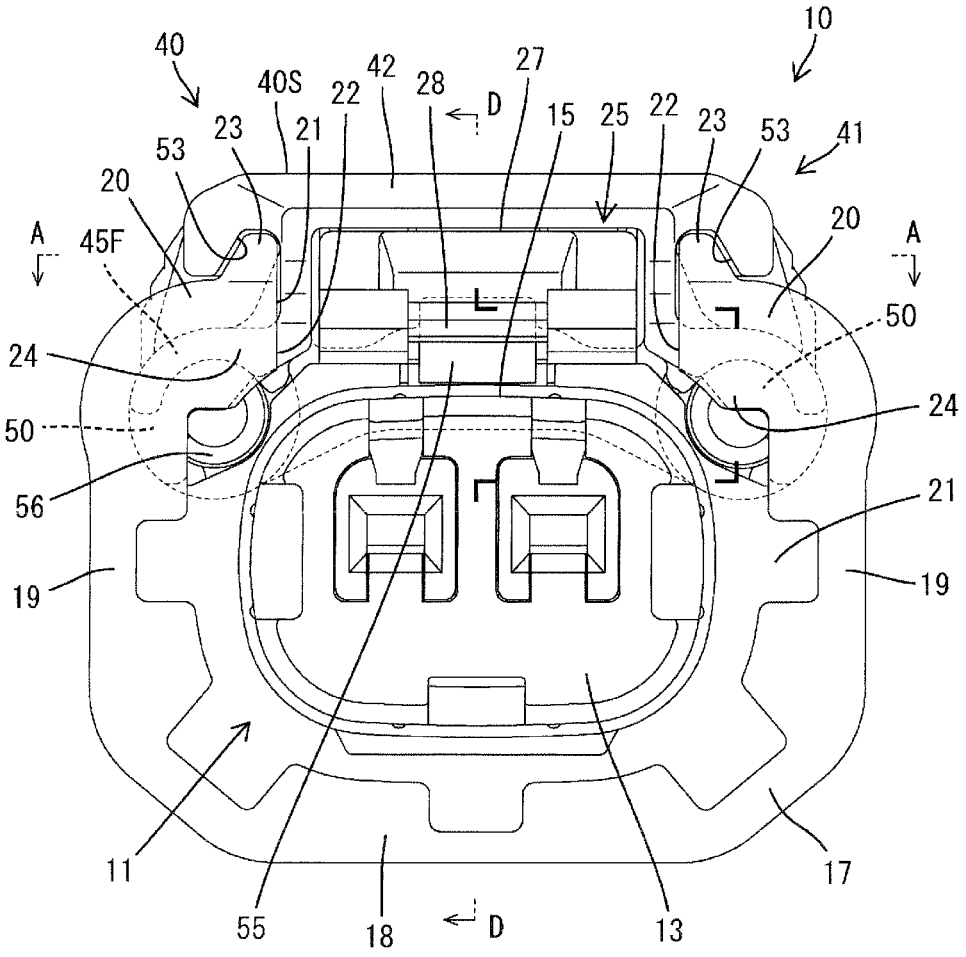
FIG. 1 is a front view showing a state where a detecting member is assembled with a first housing in one embodiment.
Figure 13:
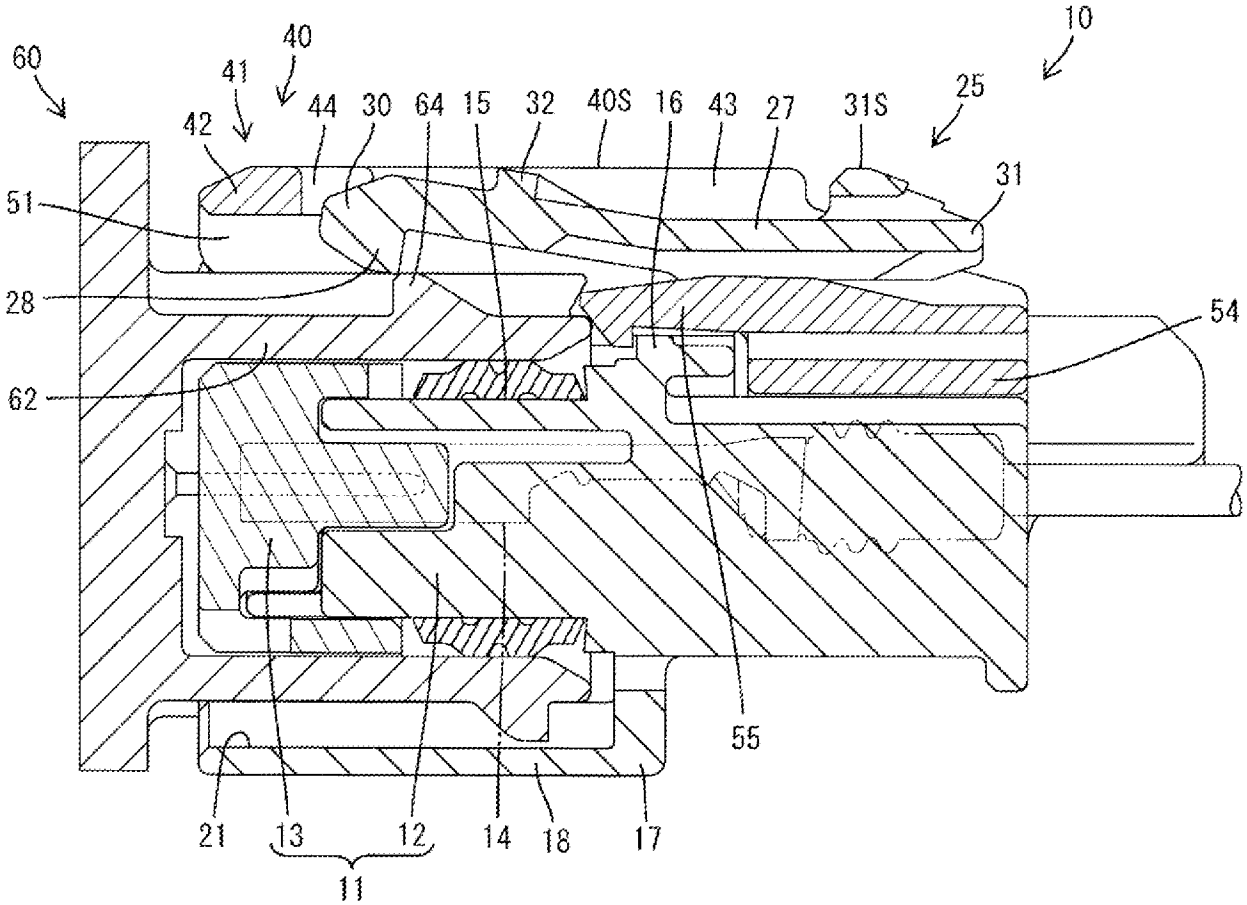
FIG. 13 is a side view in section cut at the same position of line B-B of FIG. 2 in the process of connecting the first and second housings.

As shown in FIG. 1, the first housing 10 is composed of a terminal accommodating portion 11 and a peripheral wall portion 17 surrounding the terminal accommodating portion 11. As shown in FIG. 13, the terminal accommodating portion 11 is composed of a housing main body 12 and a front member 13 assembled with a front end part of the housing main body 12. A pair of left and right female terminal fittings 14 are accommodated in the terminal accommodating portion 11.

An upper surface 15 of the terminal accommodating portion 11 (housing main body 12) is formed with a first stopper 16 in the form of a step projecting in a widthwise central part. The first stopper 16 is a means for holding the detecting member 40 to be described later at an initial position in a state where the detecting member 40 is biased toward a detection position by the spring members 56.

<Peripheral Wall Portion 17>

As shown in FIG. 1, the peripheral wall portion 17 is composed of a lower wall portion 18 facing the lower surface of the terminal accommodating portion 11, a pair of left and right side wall portions 19 facing the side surfaces of the terminal accommodating portion 11 and a pair of left and right protruding portions 20 protruding inwardly in a cantilever manner from the upper end edges (end edges opposite to the lower wall portion 18) of the both side wall portions 19. A space between the outer peripheral surface of the terminal accommodating portion 11 and the inner peripheral surface of the peripheral wall portion 17 serves as a connection space 21 into which a receptacle 62 of the second housing 60 is fitted. The connection space 21 is open forwardly (toward a front side) of the first housing 10.

Figure 8:
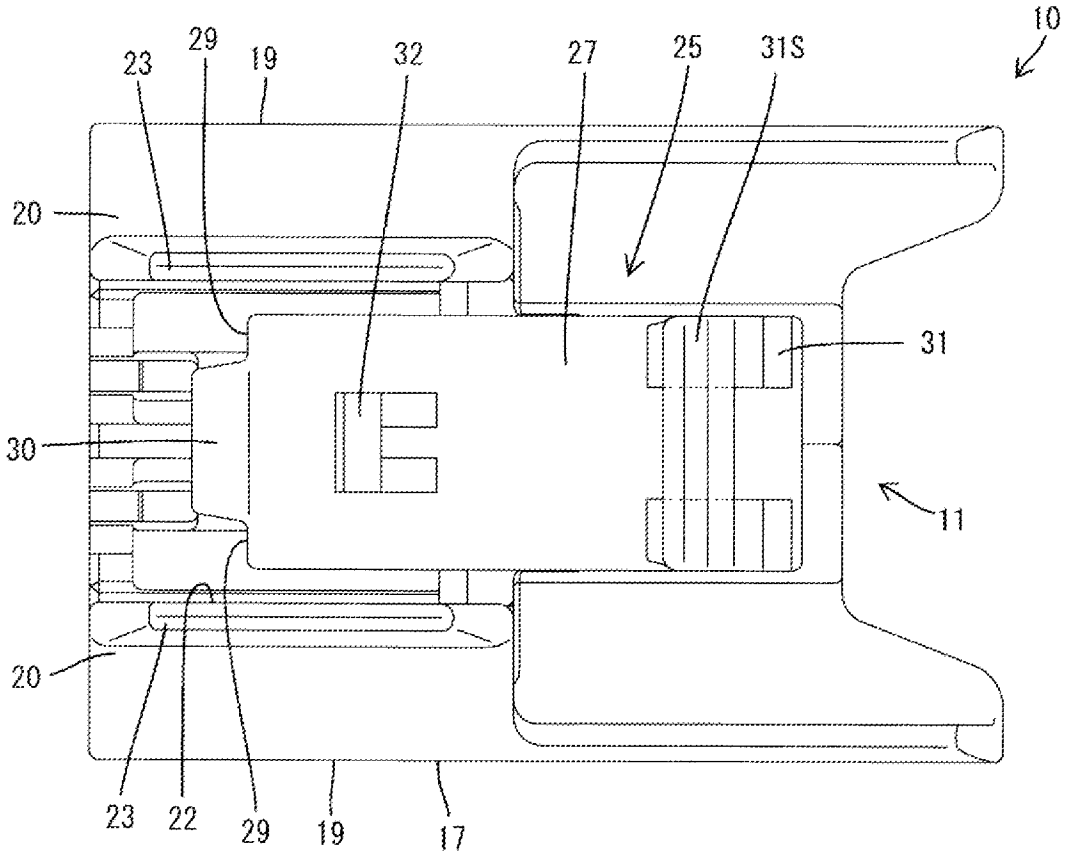
FIG. 8 is a plan view of the first housing.

A part (upper surface part) of the peripheral wall portion 17 in a circumferential direction is cut and this cut part serves as an opening 22 for exposing the connection space 21 and the detecting member 40 to an outer peripheral side (upper side) of the peripheral wall portion 17. As shown in FIG. 8, a formation range of the opening 22 in a front-back direction (direction parallel to a connecting direction of the two housings 10, 60) is the entire area of the peripheral wall portion 17 from the front end to the rear end and the opening 22 is open forwardly of the first housing 10. As shown in FIG. 13, the front end of the peripheral wall portion 17 is at the same position as that of the terminal accommodating portion 11 in the front-back direction. The rear end of the peripheral wall portion 17 is connected to the outer periphery of the terminal accommodating portion 11 at a substantially center position of the terminal accommodating portion 11 in the front-back direction. That is, the peripheral wall portion 17 is cantilevered forwardly.

Figure 6:
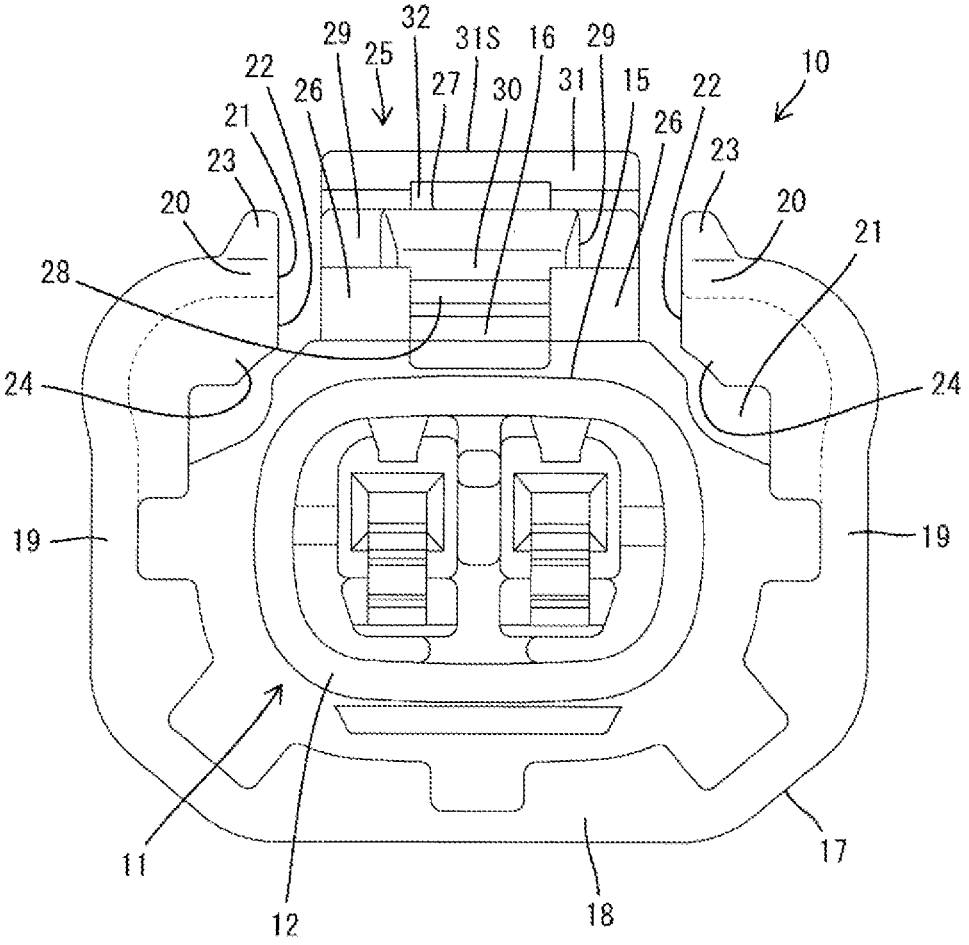
FIG. 6 is a front view of a housing main body of the first housing.

As shown in FIGS. 1 and 6, the peripheral wall portion 17 is formed with a pair of bilaterally symmetrical ribs 23. The ribs 23 extend straight in the front-back direction along extending end edges of the protruding portions 20, i.e. along opposite left and right side edges of an opening area of the opening 22. The ribs 23 project to the outer peripheral side of the peripheral wall portion 17. These ribs 23 have both a function of regulating such deformation of the peripheral wall portion 17 as to change an opening width of the opening 22 and a function of guiding movements of the detecting member 40 between the initial position and the detection position.

As shown in FIGS. 1 and 6, the peripheral wall portion 17 is integrally formed with covering portions 24 projecting radially inwardly (toward the connection space 21) from the front end edges (end edges on a front side) of the protruding portions 20. A pair of the covering portions 24 are bilaterally symmetrically provided. A formation area of the covering portion 24 in the circumferential direction is a range from an upper end part of the side wall portion 19 to the entire area of the protruding portion 20. When the first housing 10 is viewed from front, i.e. on a virtual projection surface (not shown) projected in parallel to the connecting direction of the two housings 10, 60, the covering portions 24 are shaped and arranged to correspond to a front wall 50 of the detecting member 40.

<Lock Arm 25>

Figure 7:
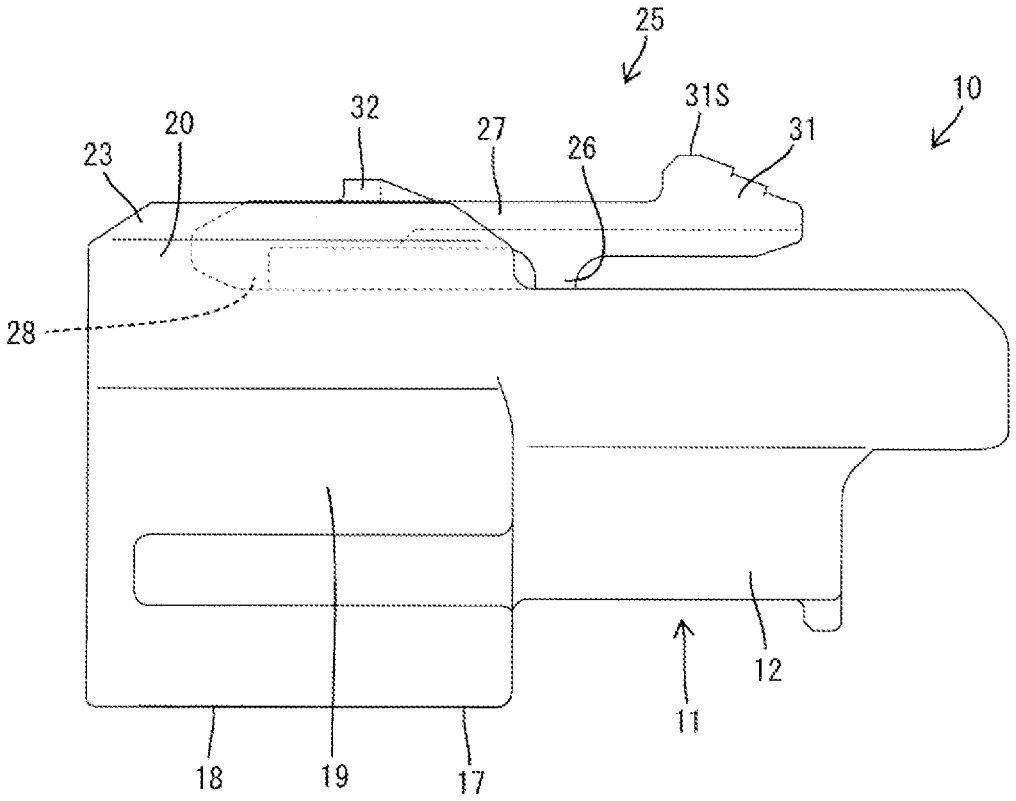
FIG. 7 is a side view of the first housing.

As shown in FIGS. 6 to 8, the housing main body 12 constituting the terminal accommodating portion 11 is integrally formed with a lock arm 25. The lock arm 25 is an integral assembly of a pair of left and right leg portions 26 projecting from the upper surface 15 of the terminal accommodating portion 11 and an arm portion 27 substantially in the form of a flat plate extending forward and backward in a cantilever manner from the leg portions 26 along the outer surface of the terminal accommodating portion 11. The lock arm 25 is arranged to face substantially parallel to the upper surface 15 of the terminal accommodating portion 11 in the connection space 21. The lock arm 25 is resiliently deformable in a seesaw manner with the leg portions 26 as a supporting point.

Figure 2:
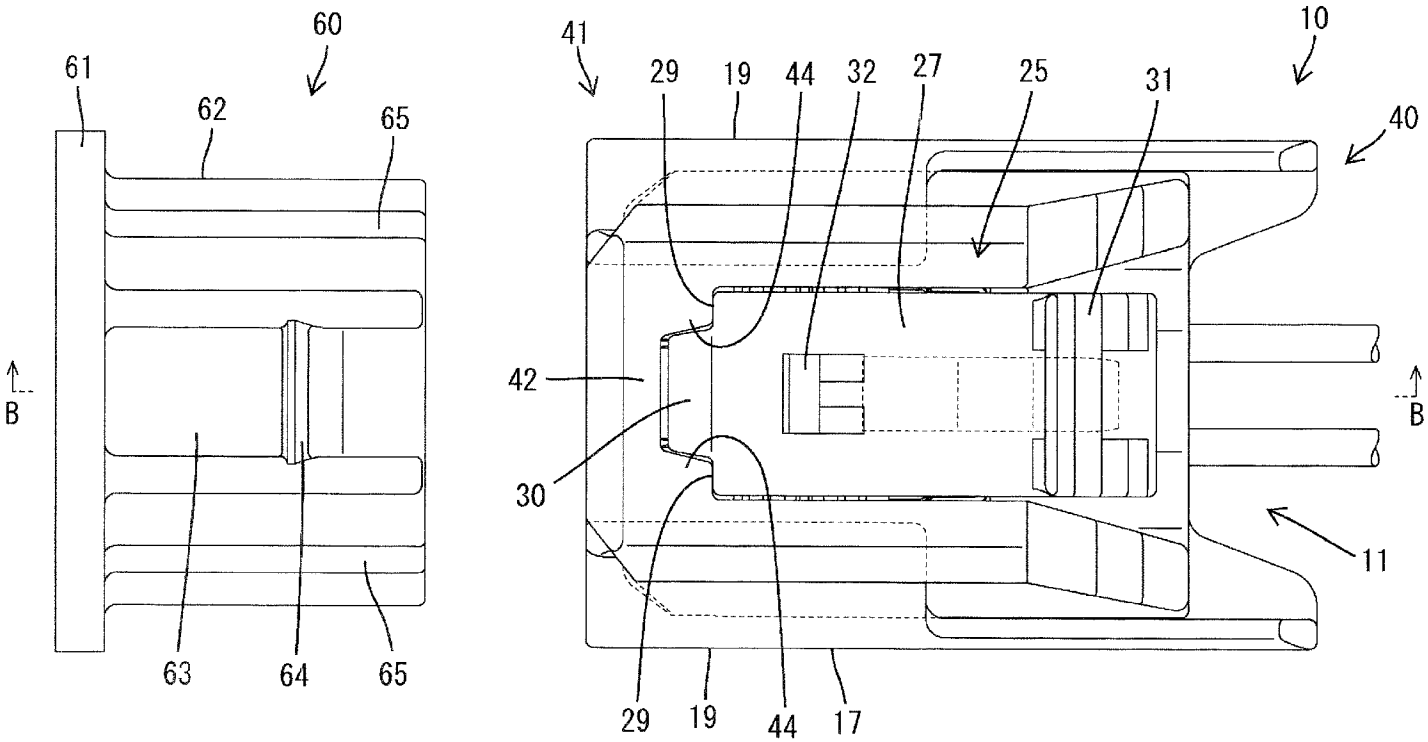
FIG. 2 is a plan view showing a state before the first housing and a second housing are connected.

A lock projection 28 projecting downward (toward the terminal accommodating portion 11) is formed on a front end part (end part on the front side of the first housing 10) of the lock arm 25. A formation range of the lock projection 28 in a width direction thereof (direction intersecting with both a resilient displacing direction of the lock arm 25 and the connecting direction of the two housings 10, 60) is only a central part of the lock arm 25. As shown in FIG. 2, opposite widthwise end parts of the front end part of the lock arm 25 where the lock projection 28 is not formed are cut to form a pair of left and right cut portions 29. A part of the front end part of the lock arm 25 where the lock projection 28 is formed between the both cut portions 29 serves as a narrow portion 30.

As shown in FIGS. 6 to 8, an unlocking portion 31 projecting in a direction away from the terminal accommodating portion 11 (toward a side opposite to the lock projection 28) is formed on a rear end part of the lock arm 25. A height of an outer surface 31S of the unlocking portion 31 from the upper surface 15 of the terminal accommodating portion 11 as a reference in a facing direction of the upper surface 15 of the terminal accommodating portion 11 and the lock arm 25 (hereinafter, referred to as a "height direction") is higher than that of the outer surface of the arm portion 27. That is, the outer surface 31S of the unlocking portion 31 is located at a most distant position (highest position) of the lock arm 25 from the upper surface 15 of the terminal accommodating portion 11. Further, the outer surface 31S of the unlocking portion 31 is located higher than the upper end edges of the ribs 23 of the peripheral wall portion 17.

A second stopper 32 for regulating a movement of the later-described detecting member 40 having reached the detection position when the detecting member 40 moves from the initial position to the detection position is formed to project on the upper surface of the arm portion 27. The position of the outer surface (upper surface) of the second stopper 32 from the upper surface 15 of the terminal accommodating portion 11 as a reference is lower than the outer surface 31S of the unlocking portion 31, but higher than the upper end edges of the ribs 23. A formation range of the second stopper 32 in the width direction is only a central part of the lock arm 25 and a width of the second stopper 32 is smaller than that of the narrow portion 30.

<Detecting Member 40>

Figure 9:
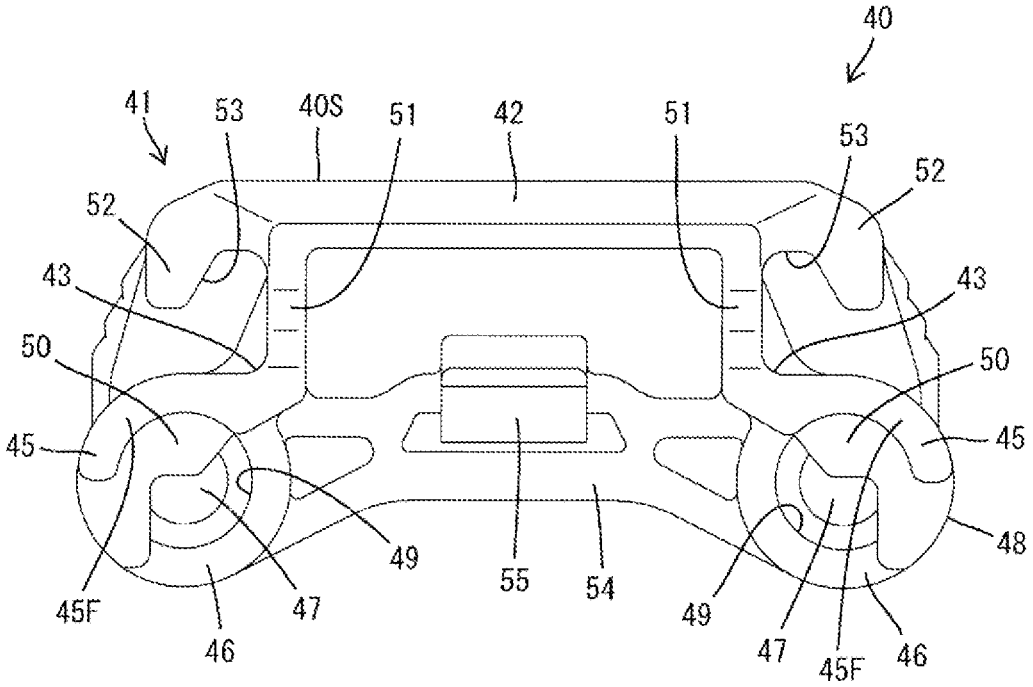
FIG. 9 is a front view of the detecting member.
Figure 10:
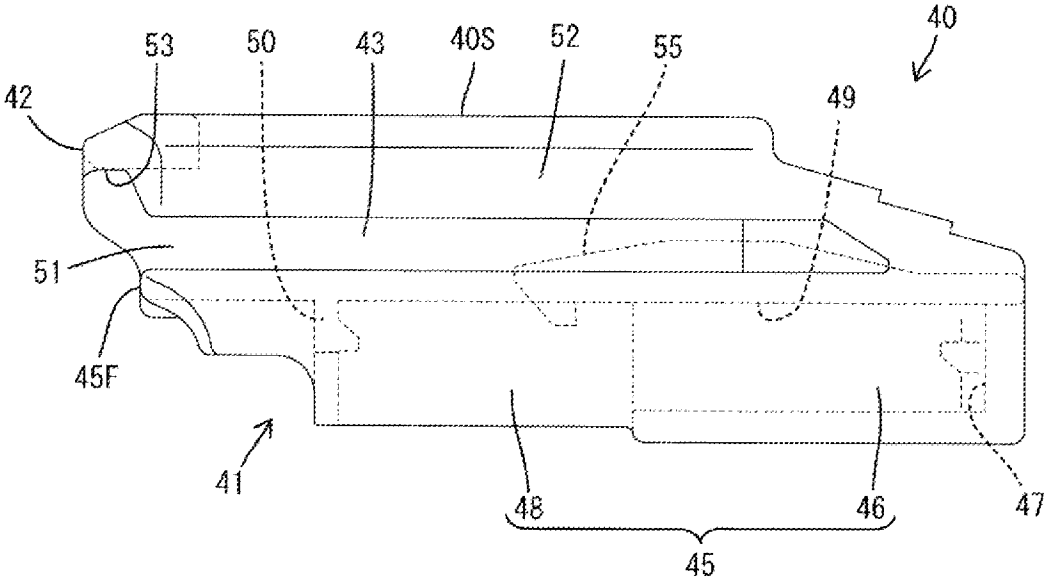
FIG. 10 is a side view of the detecting member.
Figure 11:
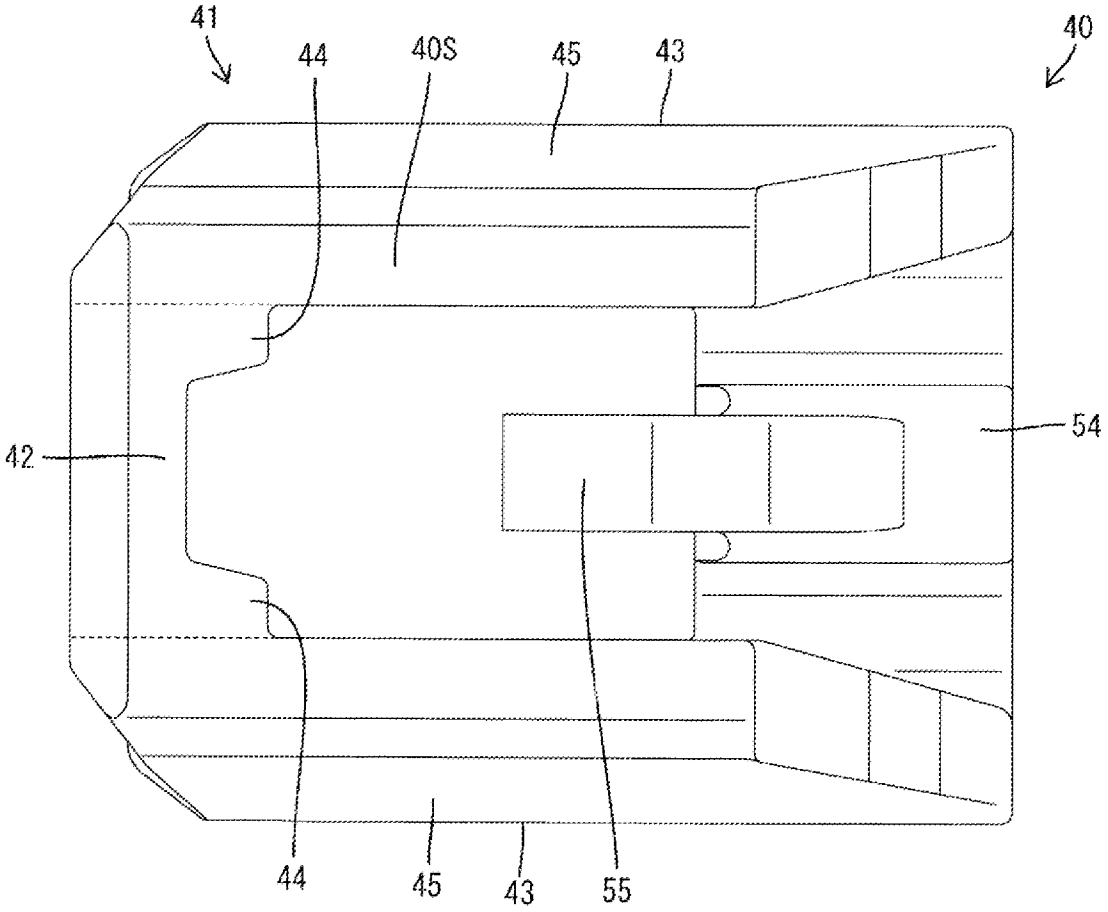
FIG. 11 is a plan view of the detecting member.

As shown in FIGS. 9 to 11, the detecting member 40 is an integral assembly of a frame portion 41 constituting an outer surface 40S of the detecting member 40 and a coupling portion 54. The frame portion 41 is composed of a front frame 42 whose length direction is aligned with the width direction and a pair of bilaterally symmetrical side frames 43 extending backward from opposite left and right ends of the front frame 42. The upper surfaces of the front frame 42 and the side frames 43 in the height direction from the upper surface 15 of the terminal accommodating portion 11 as a reference serve as the outer surface 40S arranged at a highest position of the detecting member 40. This outer surface 40S is substantially at the same height as the outer surface 31S of the lock arm 25.

As shown in FIG. 13, the front frame 42 is substantially in the form of a flat plate substantially parallel to the upper surface 15 of the terminal accommodating portion 11. As shown in FIG. 11, the front end edge of the front frame 42 is located at the foremost position of the detecting member 40 and extends substantially straight in a lateral direction. A dimension of the front frame 42 in the front-back direction is small in a widthwise central part and large on opposite widthwise end sides. Parts protruding backward on the opposite widthwise end parts of the front frame 42 serve as a pair of reinforcing portions 44. These reinforcing portions 44 are connected to front end parts of the side frames 43 and function as a means for enhancing the strength of the front frame 42. Further, formation areas of the pair of reinforcing portions 44 in the width direction are areas corresponding to the cut portions 29 of the lock arm 25, i.e. ranges not corresponding to the narrow portion 30.

Figure 3:
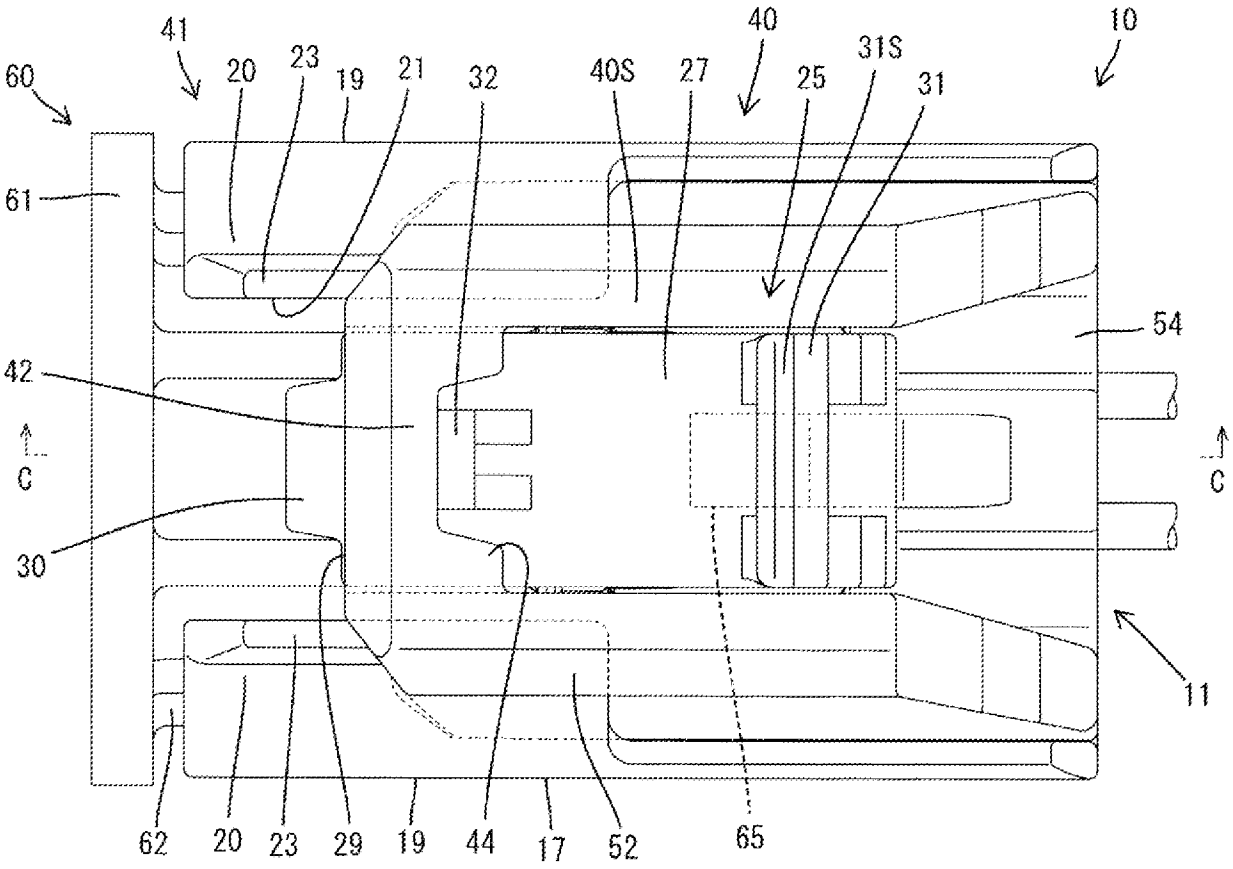
FIG. 3 is a plan view showing a state where the first and second housings are properly connected and the detecting member is displaced to a detection position.
Figure 16:
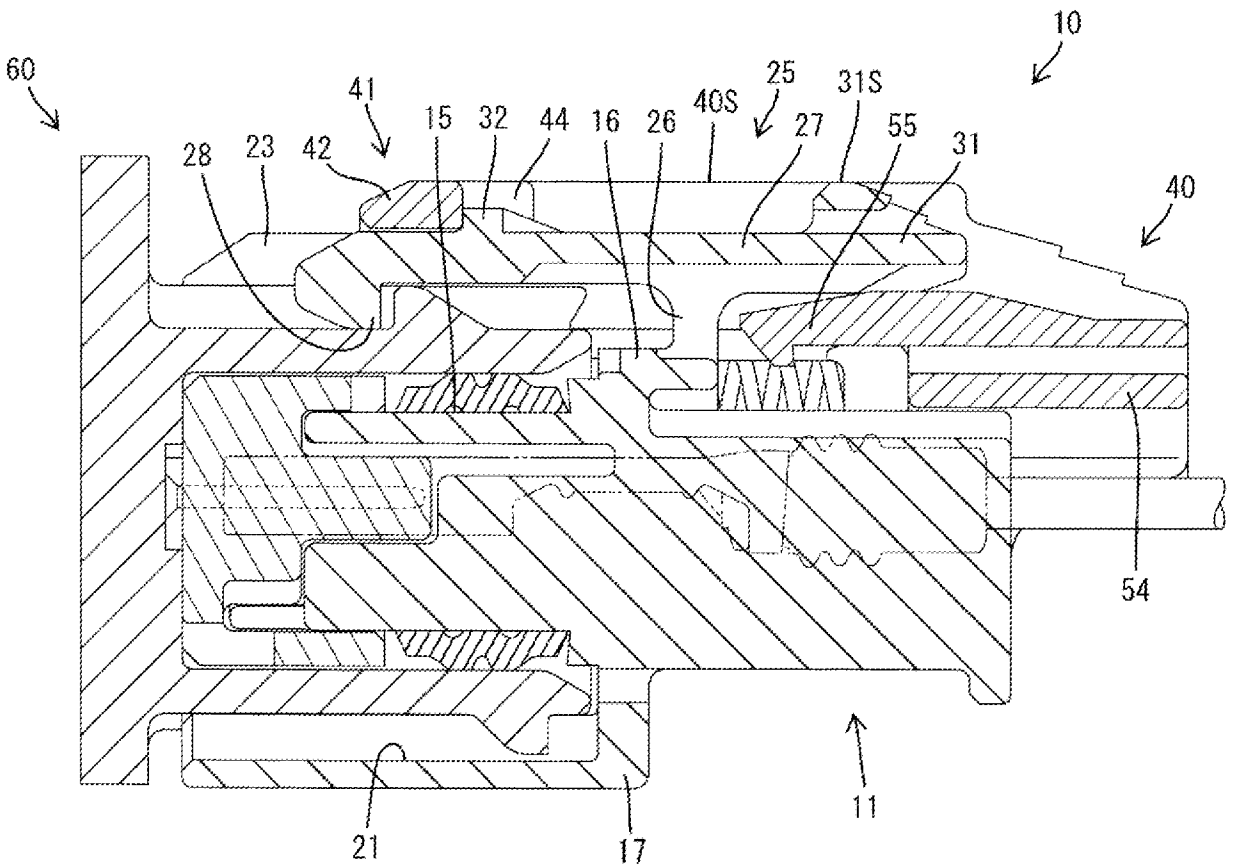
FIG. 16 is a section along line C-C of FIG. 3.

As shown in FIGS. 3 and 16, a central part of the front frame 42 between the pair of reinforcing portions 44 function as a means for holding the detecting member 40 at the detection position by coming into contact with the second stopper 32 when the detecting member 40 is pushed from the initial position toward the detection position by being biased by the spring members 56. Further, as shown in FIG. 16, the entire width area of the front frame 42 functions as an unlocking regulation means for regulating a resilient displacement of the lock arm 25 at a locking position to an unlocking position.

Figure 17:
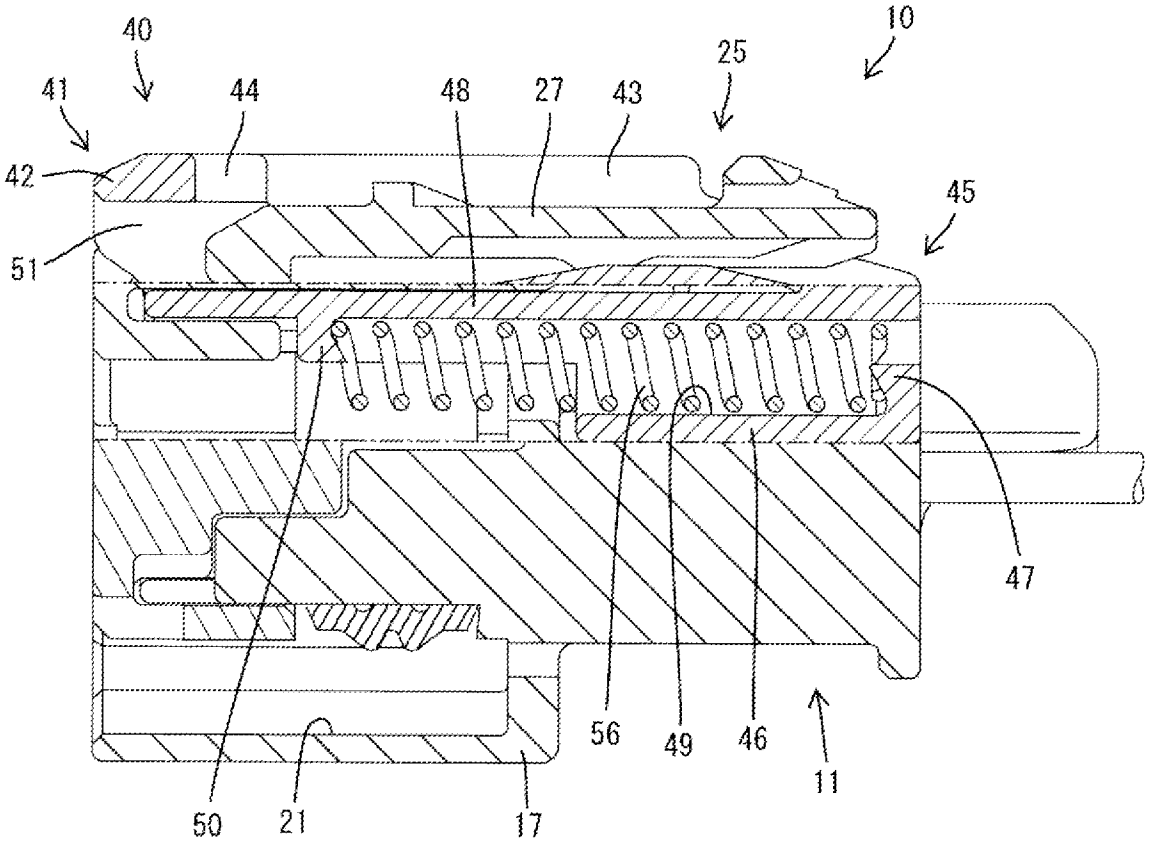
FIG. 17 is a section along line D-D of FIG. 1.

As shown in FIGS. 9, 10 and 17, the side frames 43 include a pair of left and right spring accommodating portions 45. The spring accommodating portion 45 is composed of a hollow cylindrical portion 46 having an axis aligned with the front-back direction and having the rear end partly closed by a rear wall 47, and an arcuate portion 48 continuous and flush with the front end of the hollow cylindrical portion 46. A formation area of the arcuate portion 48 in the circumferential direction is a range corresponding to an upper quarter-circular arcuate area and a quarter-circular arcuate area of a side part located at an outer side in the width direction out of two side parts when the hollow cylindrical portion 46 is virtually divided into four upper, lower, left and right quarter-circular arcuate areas.

As shown in FIGS. 9 and 17, a space long and narrow in the front-back direction and surrounded by the hollow cylindrical portion 46 and the arcuate portion 48 serves as a spring accommodation space 49. The spring member 56 formed of a compression coil spring is coaxially accommodated in the spring accommodation space 49. A front wall 50 projecting inwardly is formed on the front end edge of the arcuate portion 48. The front surface of the front wall 50 is located slightly behind the front end edge of the front frame 42. The front wall 50 partly covers an opening area on the front end of the spring accommodation space 49. The spring member 56 is sandwiched between the rear wall 47 and the front wall 50, whereby the separation thereof from the spring accommodation space 49 is regulated. An area of a front end part of the spring member 56 not corresponding to the front wall 50 is exposed forward (toward the front side).

As shown in FIG. 9, the side frame 43 includes a standing wall portion 51 integrally formed to the spring accommodating portion 45. The standing wall portion 51 stands upward from an inner side edge part of the upper surface of the spring accommodating portion 45 and extends straight in the front-back direction. The upper end edge of the standing wall portion 51 is connected substantially at a right angle to opposite left and right ends of the front frame 42. The side frame 43 includes an eaves portion 52 integrally formed to the standing wall portion 51. The eaves portion 52 protrudes outwardly in the width direction from the upper end edge of the standing wall portion 51 and extends obliquely downward in a cantilever manner to approach the spring accommodating portion 45. Similarly to the standing wall portion 51, the eaves portion 52 also extends in the front-back direction. The upper end edge of the standing wall portion 51 and the upper end surface of the eaves portion 52 constitute the outer surface 40S of the detecting member 40 similarly to the upper surface of the front frame 42.

The side frames 43 include a pair of left and right groove portions 53. The groove portion 53 is surrounded by the upper surface of the spring accommodating portion 45, the standing wall portion 51 and the eaves portion 52 and the front end thereof is open. Further, the groove portion 53 is open outward in the width direction over the entire length thereof. In cooperation with the ribs 23, the groove portion 53 exhibits a function of regulating such deformation of the peripheral wall portion 17 as to change the opening width of the opening 22 and a function of guiding movements of the detecting member 40 between the initial position and the detection position.

As shown in FIG. 11, the coupling portion 54 couples lower end parts (hollow cylindrical portions 46) on the rear ends of the side frames 43. The detecting member 40 is formed into a frame shape having a substantially rectangular planar shape by this coupling portion 54 and the frame portion 41. The coupling portion 54 is formed with a deflective locking piece 55 extending forward in a cantilever manner. The deflective locking piece 55 is located in a central part in the width direction and resiliently displaceable in vertical directions (directions toward and away from the upper surface 15 of the terminal accommodating portion 11).

Figure 4:
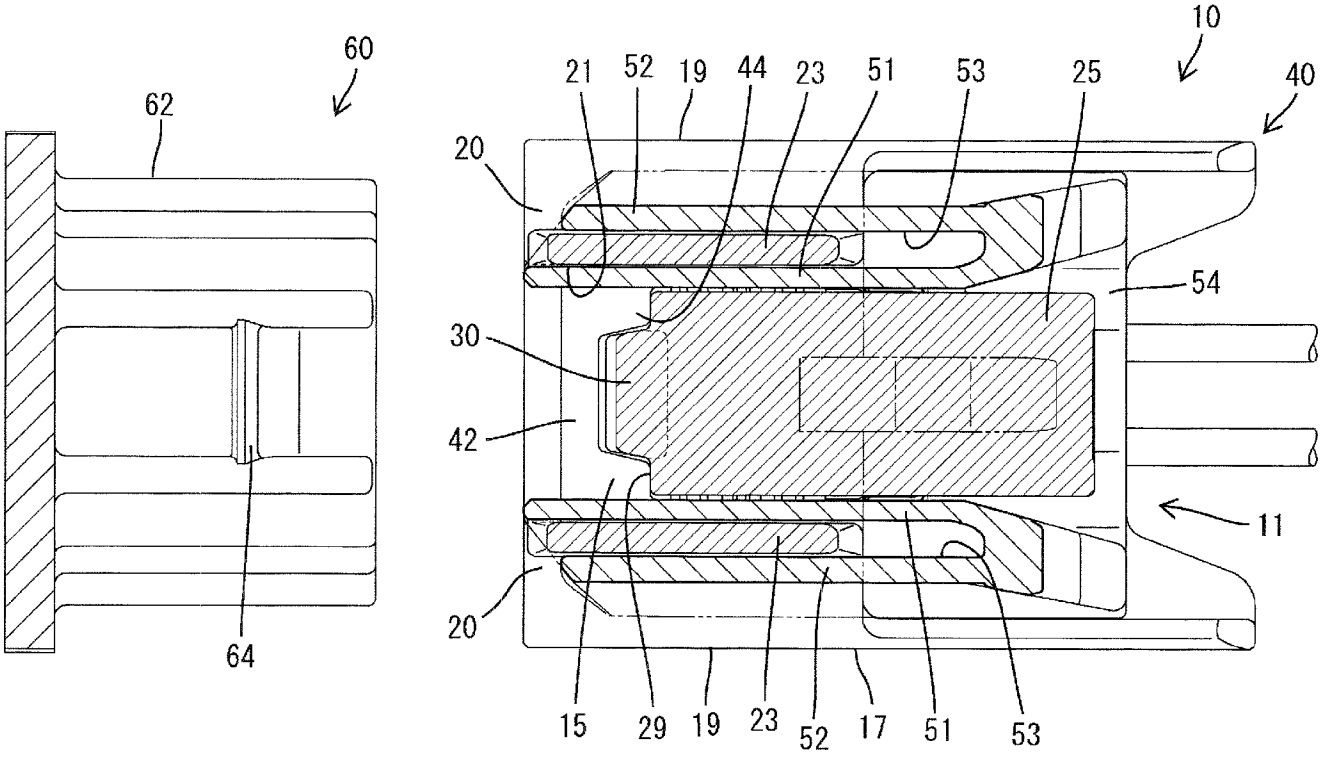
FIG. 4 is a plan view in section cut at a height of line A-A of FIG. 1 in the state before the first and second housings are connected.
Figure 5:
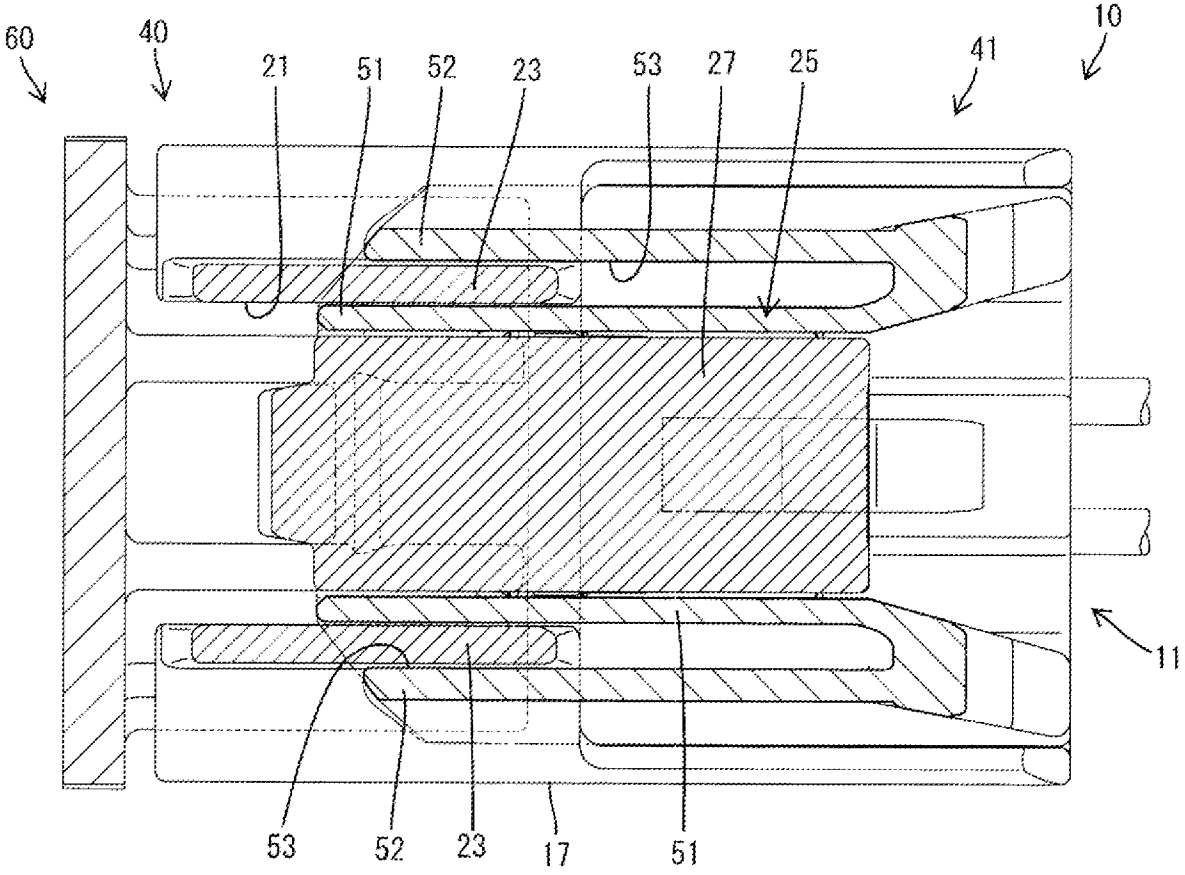
FIG. 5 is a plan view in section cut at the height of line A-A of FIG. 1 showing the state where the first and second housings are properly connected and the detecting member is displaced to the detection position.

The detecting member 40 configured as described above is so assembled with the first housing 10 as to be movable between the initial position and the detection position. The initial position is set on a front end in a displacement range of the detecting member 40 and the detection position is set on a rear end in the displacement range of the detecting member 40. As shown in FIGS. 1 and 4, the detecting member 40 is assembled by fitting the groove portions 53 to the ribs 23 from behind the first housing 10. By fitting the ribs 23 and the groove portions 53, the detecting member 40 is guided to be smoothly movable between the initial position and the detection position.

In a state where the detecting member 40 is assembled with the first housing 10, at least front end areas of the spring accommodating portions 45 are located in the connection space 21, the standing wall portions 51 penetrate through the opening 22 and the entire front frame 42 and the entire eaves portions 52 are located at the outer peripheral side of the peripheral wall portion 17 (outside the connection space 21). Further, as shown in FIG. 3, inner edge parts of the both left and right side frames 43 are located slightly outwardly of the opposite left and right outer edges of the lock arm 25 (arm portion 27) in the width direction.

Further, as shown in FIGS. 12 and 14 to 16, the entire lock arm 25 is located within a height range from the upper end to the lower end of the detecting member 40 in the height direction when the lock arm 25 is at the locking position. A front end part of the coupling portion 54 and the entire deflective locking piece 55 are located below the lock arm 25 (between the lock arm 25 and the terminal accommodating portion 11). The front frame 42 is located above the arm portion 27 of the lock arm 25.

Figure 12:
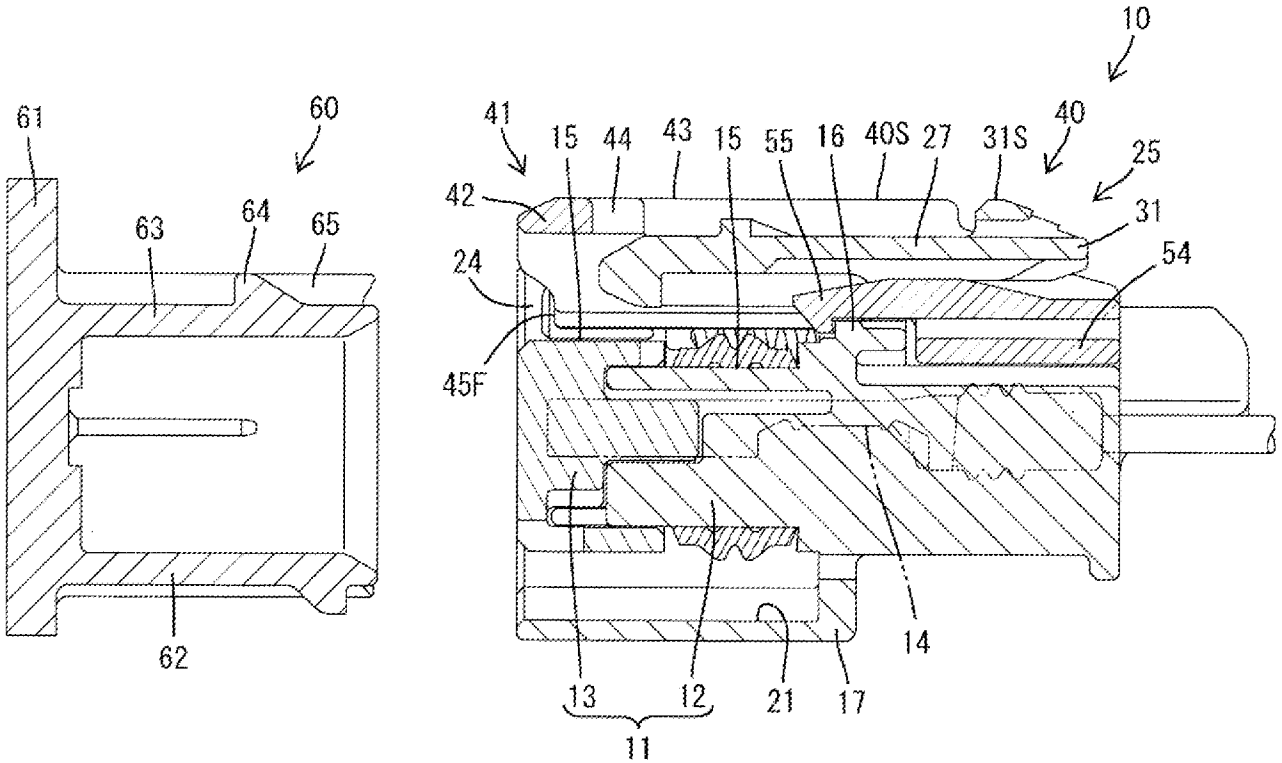
FIG. 12 is a section along line B-B of FIG. 2.

With the detecting member 40 located at the initial position, front end surfaces 45F of the spring accommodating portions 45 of the side frames 43 are in contact with the covering portions 24 of the peripheral wall portion 17 from behind and a front end part of the deflective locking piece 55 is locked to the first stopper 16 from front as shown in FIG. 12. By the contact with the covering portions 24 and the locking of the first stopper 16, the detecting member 40 is held at the initial position. Note that the front end surfaces 45F of the spring accommodating portions 45 are located behind the foremost end surfaces of the standing wall portions 51 and the front frame 42. With the detecting member 40 located at the detection position, the deflective locking piece 55 is separated from the first stopper 16 and the front frame 42 is in contact with the second stopper 32 from front (initial position side) as shown in FIG. 16. By this contact action, a backward displacement of the detecting member 40 from the detection position is regulated.

With the detecting member 40 located at the initial position, the front frame 42 is located before the front end edge of the lock arm 25 as shown in FIGS. 2 and 12. That is, the rear edge of a central part of the front frame 42 where the reinforcing portions 44 are not formed is located slightly before the front end edge of the narrow portion 30 of the lock arm 25. Thus, as shown in FIG. 13, the lock arm 25 can be resiliently displaced to the unlocking position to enter a space surrounded by the frame portion 41 while the front end area where the lock projection 28 is formed is displaced upwardly. With the detecting member located at the detection position, the front frame 42 is located to overlap the front end edge of the lock arm 25 from above as shown in FIGS. 3 and 16. Thus, even if the lock arm 25 is going to be resiliently displaced to the unlocking position, it comes into contact with the front frame 42, wherefore a resilient displacement of the lock arm 25 to the unlocking position is regulated and the lock arm 25 is held at the locking position.

<Second Housing 60>

As shown in FIGS. 2 and 12, the second housing 60 is an integral assembly of a terminal holding portion 61 and the receptacle 62 in the form of a rectangular tube extending forward from the terminal holding portion 61. An upper wall 63 constituting the receptacle 62 is formed with a lock receiving portion 64 projecting from the outer surface (upper surface) thereof. A pair of pressing portions 65 arranged at opposite widthwise sides of the lock receiving portion 64 are formed to project on the upper wall 63 of the receptacle 62. In connecting the two housings 10, 60, the receptacle 62 is fitted into the connection space 21.

<Functions and Effects of Embodiment>

In connecting the two housings 10, 60, the detecting member 40 is held at the initial position in advance as shown in FIG. 12. Then, by inserting the receptacle 62 into the connection space 21, the connection of the two housings 10, 60 is started. In the process of the connection, the lock receiving portion 64 comes into contact with the front end part (narrow portion 30) of the lock arm 25 as shown in FIG. 13. By this pressing action of the lock receiving portion 64, an area of the lock arm 25 before the leg portions 26 is resiliently displaced upwardly (unlocking direction) to enter the space surrounded by the frame portion 41 and the lock projection 28 moves onto the lock receiving portion 64.

Figure 18:
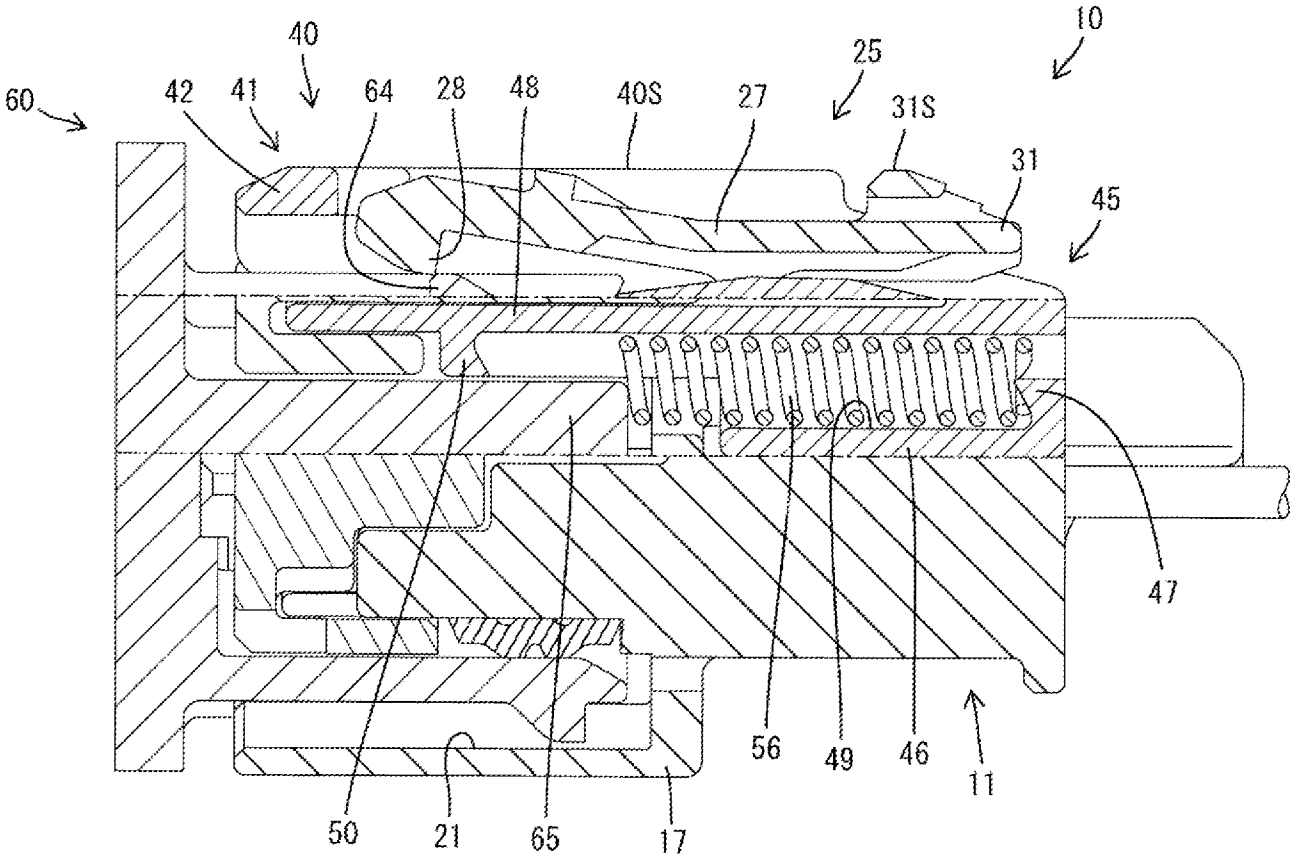
FIG. 18 is a side view in section cut at the same position as line D-D of FIG. 1 in the same state as in FIG. 13.

While the connection of the two housings 10, 60 progresses up to the state of FIG. 13 after being started, the spring members 56 are pushed from front by the pressing portions 65 of the receptacle 62 and compressively deformed between the pressing portions 65 and the rear wall 47 as shown in FIG. 18. By this compressive deformation of the spring members 56, a biasing force in a direction from the initial position to the detection position is applied to the detecting member 40. However, since the deflective locking piece 55 is kept locked to the first stopper 16 as shown in FIG. 13, the detecting member 40 remains at the initial position while being biased toward the detection position.

Figure 14:
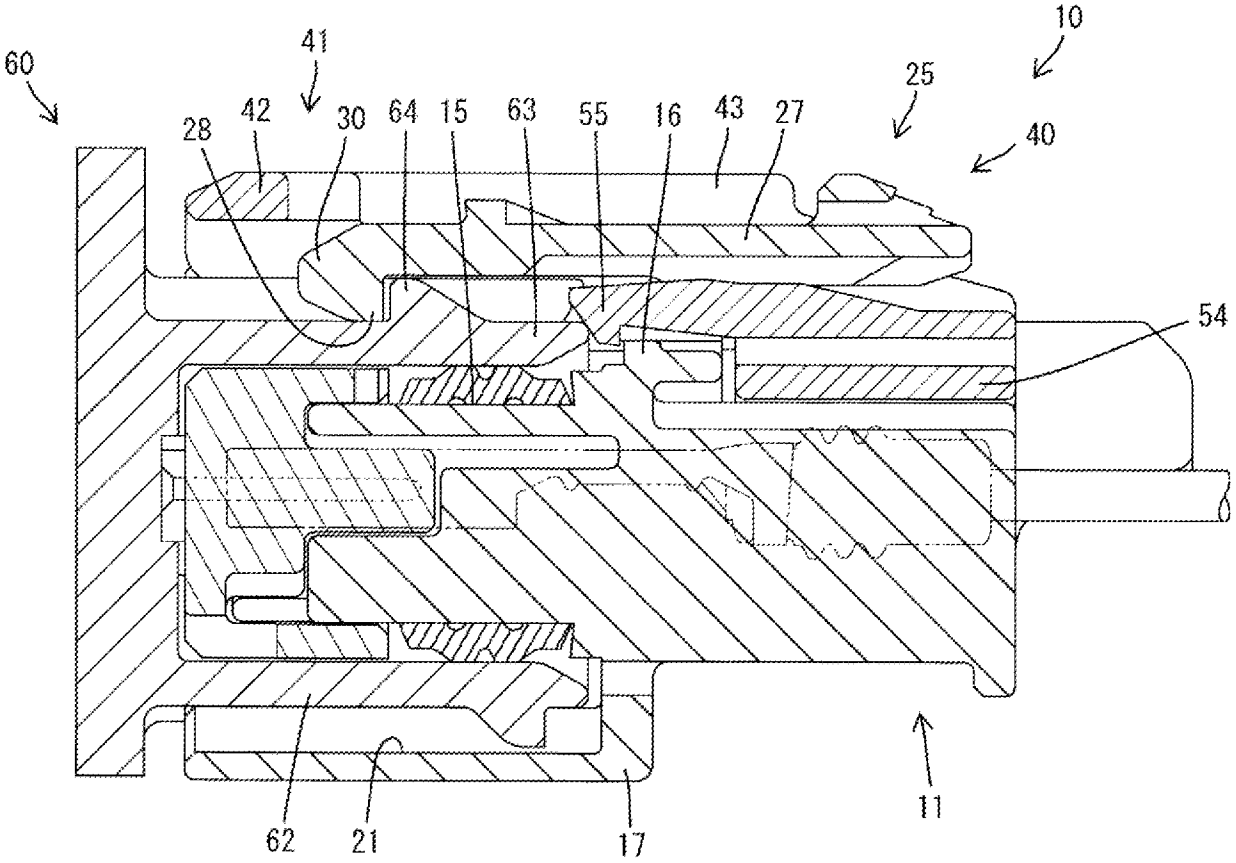
FIG. 14 is a side view cut at the same position as line B-B of FIG. 2 in a state where the connection of the first and second housings is further advanced from a state of FIG. 13.

When the connection slightly progresses from the state of FIG. 13, the lock projection 28 passes over the lock receiving portion 64 as shown in FIG. 14. Thus, the lock arm 25 resiliently returns and the lock projection 28 is locked to the lock receiving portion 64. By this locking action, the two housings 10, 60 are locked in a state where the separation thereof is regulated. At the time of locking, a clearance enabling the continuation of a further connecting operation is secured between the front end surface of the first housing 10 and the front end surface of the terminal holding portion 61 of the second housing 60 (back end surface of the receptacle 62). Further, in a state of FIG. 14, the leading edge of the upper wall 63 of the receptacle 62 comes into contact with the front end of the deflective locking piece 55, whereby the deflective locking piece 55 is slightly resiliently displaced upwardly and a locking margin between the deflective locking piece 55 and the first stopper 16 decreases.

Figure 15:
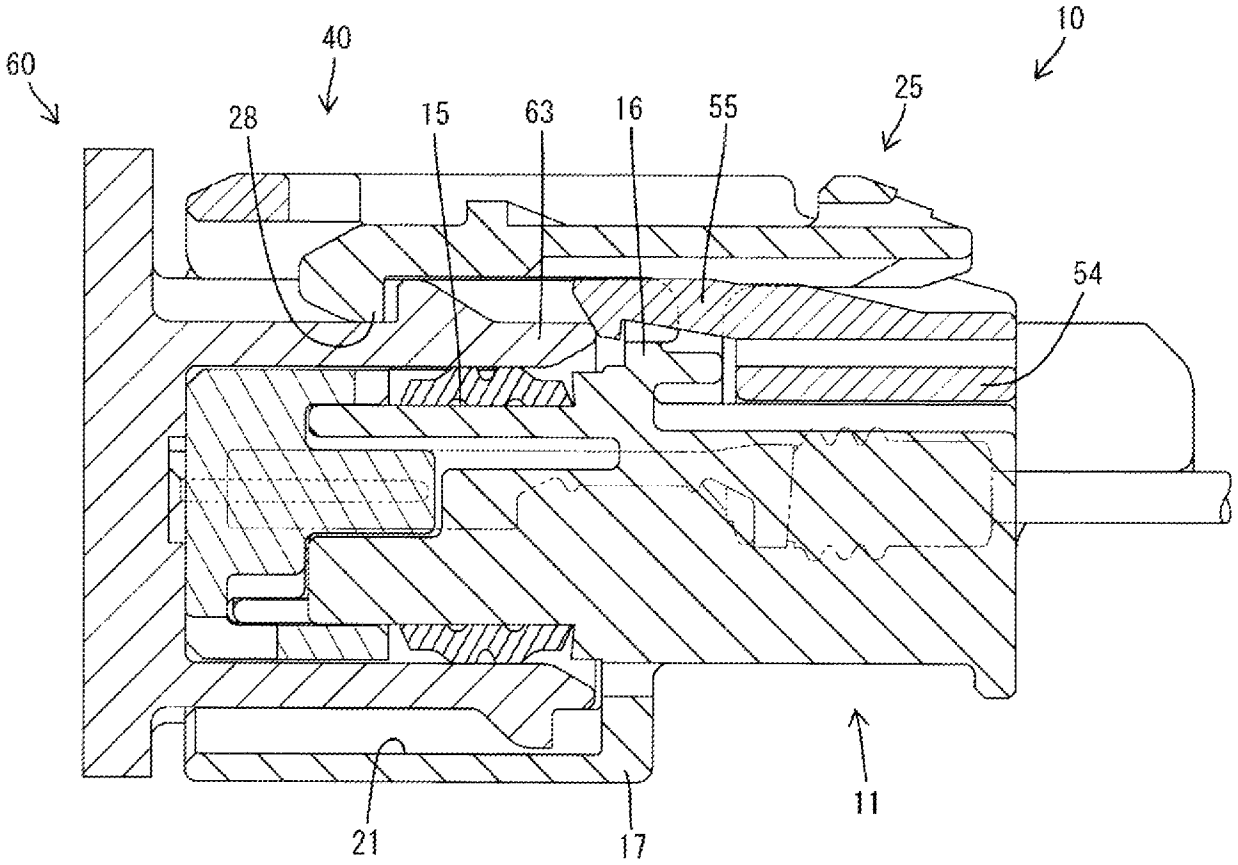
FIG. 15 is a side view cut at the same position as line B-B of FIG. 2 in a state where the connection of the first and second housings is further advanced from the state of FIG. 14.
Figure 19:
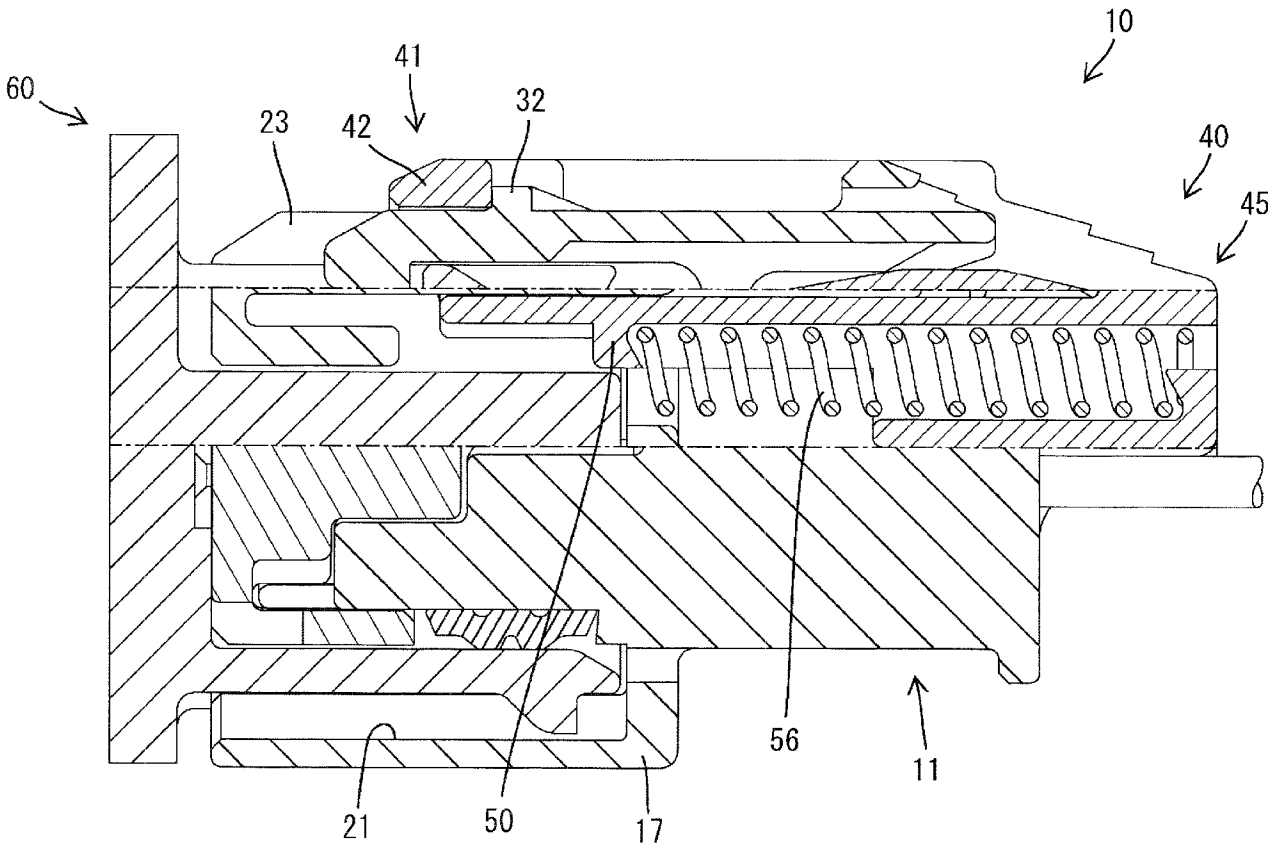
FIG. 19 is a side view in section cut at the same position as line D-D of FIG. 1 in the same state as in FIGS. 3 and 16.

When the connection progresses from the state of FIG. 14, the two housings 10, 60 collide with each other and the connecting operation is stopped as shown in FIG. 15. Since the deflective locking piece 55 is displaced further upwardly by the upper wall 63 of the receptacle 62 during this time, it is completely disengaged from the first stopper 16. Then, the detecting member 40 moves from the initial position to the detection position at once by being biased by the spring members 56 and, as shown in FIGS. 16 and 19, the front frame 42 comes into contact with the second stopper 32 and the detecting member 40 stops at the detection position. A displacement of the detecting member 40 to the detection position can be known visually and by a collision sound of the front frame 42 and the second stopper 32.

When the detecting member 40 is displaced to the detection position, the connection of the two housings 10, 60 is completed. If the connecting operation is interrupted with the two housings 10, 60 incompletely connected, the detecting member 40 remains at the initial position without moving to the detection position. Thus, an operator can detect whether or not the two housings 10, 60 has been properly connected based on whether or not the detecting member 40 has moved from the initial position to the detection position.

In this embodiment, in the process from the start of the connection of the two housings 10, 60 to the completion of the connection, the two housings 10, 60 are first locked in a properly connected state by the lock arm 25 and, thereafter, a movement of the detecting member 40 to the detection position is permitted. Thus, the detecting member 40 is held at the initial position if the connecting operation is interrupted in an incompletely connected state, wherefore the connecting operation can be resumed without performing an operation of returning the detecting member 40 from the detection position to the initial position.

In a state where the two housings 10, 60 are properly connected and the separation thereof is regulated by the lock arm 25, a resilient displacement of the front end part of the lock arm 25 in the unlocking direction (direction separating from the lock receiving portion 64) is regulated by the front frame 42 of the detecting member 40. Thus, even if the unlocking portion 31 is pressed or another member interferes with the unlocking portion 31 to apply a pressing force, a state where the lock projection 28 is locked to the lock receiving portion 64 is maintained and locking by the lock arm 25 is not released.

Figure 20:
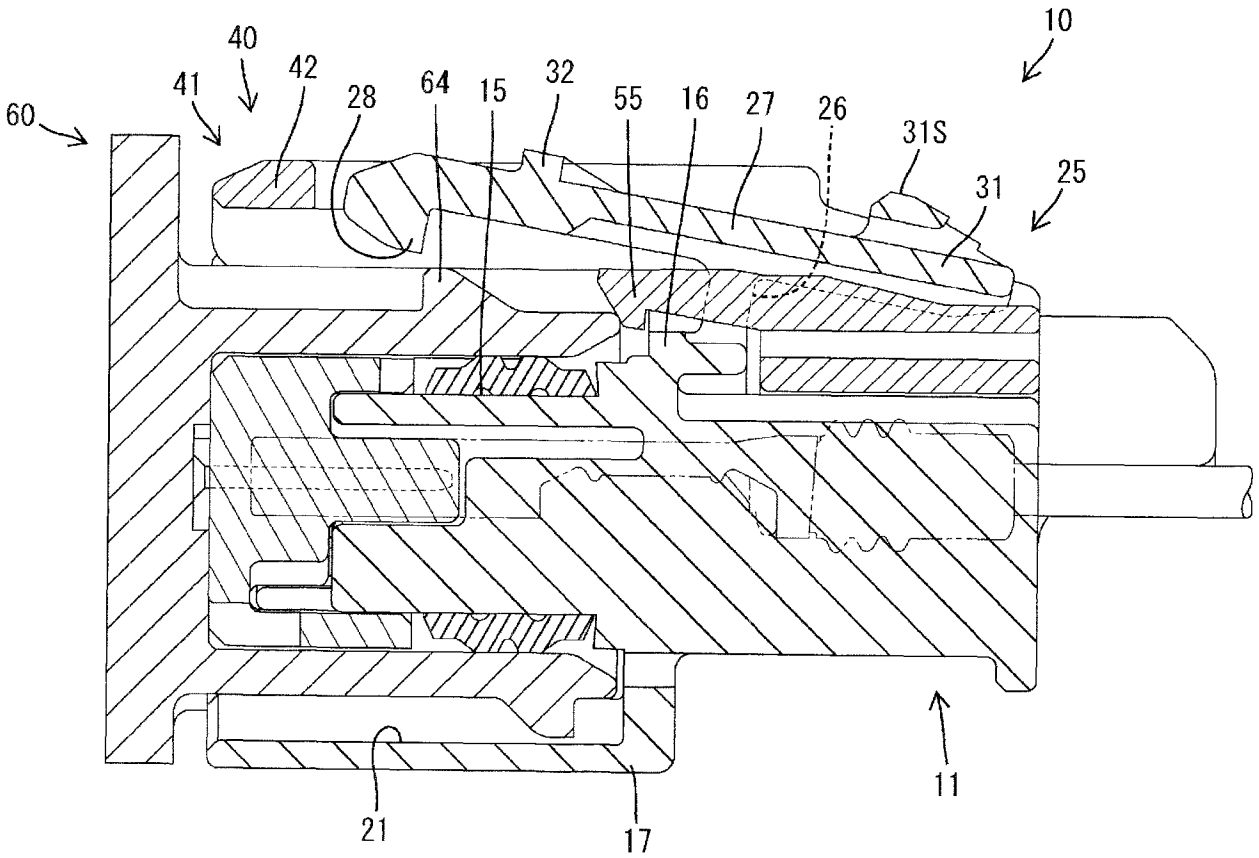
FIG. 20 is a side view in section cut at the same position as line B-B of FIG. 2 in a state where the two housings are properly connected and the detecting member is displaced to the detection position to unlock a lock arm.

In separating the two housings 10, 60 locked in the connected state, the detecting member 40 at the detection position is first moved to the initial position against the biasing of the spring members 56 before the lock arm 25 is unlocked. Then, the front end part of the lock arm 25 is released from the displacement regulation by the front frame 42, wherefore the lock arm 25 enters a state where a resilient displacement in the unlocking direction is possible. Thus, if the unlocking portion 31 is pressed downwardly with the detecting member 40 is pushed and kept at the initial position, the lock arm 25 is resiliently displaced in a seesaw manner as shown in FIG. 20, whereby the lock projection 28 is disengaged from the lock receiving portion 64 and locking by the lock arm 25 is released. Thereafter, the two housings 10, 60 may be pulled apart with the lock arm 25 kept displaced to the unlocking position.

The connector of this embodiment includes the first housing 10 formed such that the terminal accommodating portion 11 is surrounded by the peripheral wall portion 17, the second housing 60 connectable to the first housing 10 and the detecting member 40 configured to detect the connected state of the two housings 10, 60 based on whether or not the detecting member 40 moves from the initial position to the detection position in the connection space 21 between the terminal accommodating portion 11 and the peripheral wall portion 17. Further, the connector includes the opening 22 formed by cutting a part of the peripheral wall portion 17 in the circumferential direction and configured to expose the detecting member 40 to the outer peripheral side, and deformation regulating portions (ribs 23 and groove portions 53) formed on the peripheral wall portion 17 and the detecting member 40 and configured to permit the movements of the detecting member 40 between the initial position and the detection position and regulate such deformation of the peripheral wall portion 17 as to change the opening width of the opening 22 by being fitted to each other.

According to this configuration, the peripheral wall portion 17 is not present at the outer peripheral side of the detecting member 40 since the opening 22 of the peripheral wall portion 17 is open to expose the detecting member 40 to the outer peripheral side. Thus, the first housing 10 of the connector of this embodiment can be miniaturized as compared with the case where a peripheral wall portion is present at an outer peripheral side of a detecting member. Further, if the opening 22 is formed on the peripheral wall portion 17, the peripheral wall portion 17 may be deformed to change the opening width of the opening 22. However, in this embodiment, the deformation of the peripheral wall portion 17 is prevented by fitting the ribs 23 on the opening edge of the opening 22 on the peripheral wall portion 17 and the groove portions 53 formed in the detecting member 40.

Further, the ribs 23 as the deformation regulating portions of the peripheral wall portion 17 project toward the outer peripheral side from the opening edge part of the opening 22 and the groove portions 53 as the deformation regulating portions of the detecting member 40 sandwich the ribs 23 substantially in the circumferential direction and sandwich the opening edge part of the opening 22 and the ribs 23 substantially in radial directions. According to this configuration, it is possible to regulate the widening and narrowing of the opening 22 in the circumferential direction and, in addition, regulate a radial displacement of the detecting member 40 relative to the peripheral wall portion 17.

Further, the lock arm 25 configured to lock the two housings 10, 60 in the connected state is arranged in the connection space 21 between the terminal accommodating portion 11 and the peripheral wall portion 17, and the detecting member 40 and the lock arm 25 at least partly overlap in the vertical direction (height direction) in which the terminal accommodating portion 11 and the lock arm 25 are arranged. As just described, the detecting member 40 and the lock arm 25 at least partly overlap in the arrangement direction of the terminal accommodating portion 11 and the lock arm 25, whereby the first housing 10 can be miniaturized.

Further, the lock arm 25 and the detecting member 40 are arranged along the upper surface 15 of the first housing 10 and the detecting member 40 includes the frame portion 41 constituting the outer surface 40S of the detecting member 40 and configured to surround the lock arm 25 and expose the outer surface 31S of the lock arm 25. The frame portion 41 is arranged inwardly of the outer surface 31S of the lock arm 25 in the vertical direction (height direction) in which the upper surface 15 of the first housing 10 and the lock arm 25 face each other. According to this configuration, miniaturization can be realized in the direction in which the upper surface 15 of the first housing 10 and the lock arm 25 face each other.

Further, the connector of this embodiment includes the spring members 56 configured to bias the detecting member 40 toward the detection position by being pressed by the pressing portions 65 of the second housing 60 in the process of connecting the two housings 10, 60, the first stopper 16 configured to hold the detecting member 40 at the initial position against the biasing of the spring members 56 in the process of connecting the two housings 10, 60 and release the holding of the detecting member 40 when the two housings 10, 60 are connected, the front frame 42 constituting the frame portion 41 and extending in the width direction intersecting with the moving direction of the detecting member 40, and the second stopper 32 configured to stop the detecting member 40 at the detection position by the contact with the front frame 42 when the detecting member 40 released from the holding of the first stopper 16 reaches the detection position by being biased by the spring members 56. Since this front frame 42 is formed with the reinforcing portions 44 thickened in the front-back direction intersecting with the vertical direction in which the upper surface 15 of the first housing 10 and the lock arm 25 face each other, the strength of the entire front frame 42 is enhanced. Thus, it is possible to realize further miniaturization by thinning the front frame 42 in the direction in which the upper surface 15 of the first housing 10 and the lock arm 25 face each other.

Further, the detecting member 40 is formed with the front frame 42 as an unlocking regulating portion configured to regulate the resilient displacement of the lock arm 25 in the unlocking direction when the detecting member 40 is at the detection position and permit the resilient displacement of the lock arm 25 in the unlocking direction when the detecting member 40 is at the initial position. The lock arm 25 is formed with the unlocking portion 31 configured to be exposed and enable an unlocking operation by a direct manual operation when the detecting member 40 is at the initial position.

According to this configuration, in separating the two housings 10, 60 in the connected state, the detecting member 40 at the detection position is first moved to the initial position against the biasing of the spring members 56 and, thereafter, the unlocking portion 31 is directly manually operated for an unlocking operation to resiliently displace the lock arm 25 in the unlocking direction and, in this state, the two housings 10, 60 are pulled apart. That is, in this embodiment, an operation of moving the detecting member 40 from the detection position to the initial position and an operation of releasing hold on the detecting member 40 and operating the unlocking portion 31 need to be separately performed, i.e. two actions are performed. Thus, unlocking is not effected only by pushing the detecting member 40 or the unlocking portion 31 in one direction, and the two housings 10, 60 can be reliably held in the locked state.

Further, before the two housings 10, 60 are connected, the detecting member 40 is arranged at the initial position near the opening area on the front side in the connection space 21. When the two housings 10, 60 are properly connected, the detecting member 40 is displaced to the detection position on the back side in the connection space 21. The covering portions 24 extending from the opening edge on the front side of the connection space 21 are arranged to cover the detecting member 40 from front. According to this configuration, even if the receptacle 62 moves toward the detecting member 40 in the connection space 21 in the process of connecting the two housings 10, 60, the receptacle 62 comes into contact with the covering portions 24 before reaching the detecting member 40. Thus, the detecting member 40 is not pushed to the detection position by the receptacle 62 while the two housings 10, 60 are not connected or incompletely connected. Therefore, the occurrence of a detecting operation failure due to the pushing of the detecting member 40 by the receptacle 62 can be prevented.

Further, since the covering portions 24 are integrally formed to the peripheral wall portion 17, the number of components can be reduced as compared with the case where covering portions are components separate from a peripheral wall portion. Furthermore, the covering portions 24 stop the detecting member 40 in front at the initial position when the detecting member 40 is displaced from the detection position to the initial position. That is, the covering portions 24 has both a function of preventing the contact of the receptacle 62 with the detecting member 40 and a function of stopping the detecting member 40 in front at the initial position. Thus, the shapes of the first housing 10 and the detecting member 40 can be simplified as compared with the case where a means for stopping the detecting member 40 in front is formed separately from the covering portions 24.

The present invention is not limited to the above described and illustrated embodiment. For example, the following embodiments are also included in the technical scope of the present invention.

The deformation regulating portions of the peripheral wall portions are the projecting ribs and those of the detecting member are the recessed groove portions in the above embodiment. However, conversely to this, the deformation regulating portions of the peripheral wall portion may be groove portions and those of the detecting member may be ribs. Further, ribs of the peripheral wall portion and those of the detecting member may face each other in the circumferential direction.

Although the opening is open in the entire area from the front end to the rear end of the peripheral wall portion in the above embodiment, the formation area of the opening in the front-back direction may be only a part of the area from the front end to the rear end of the peripheral wall portion.

Although the detecting member and the lock arm at least partly overlap in the arrangement direction of the terminal accommodating portion and the lock arm in the above embodiment, the detecting member and the lock arm may not overlap in the arrangement direction of the terminal accommodating portion and the lock arm.

LIST OF REFERENCE SIGNS

10 . . . first housing
11 . . . terminal accommodating portion
17 . . . peripheral wall portion
22 . . . opening
23 . . . rib (deformation regulating portion of peripheral wall portion)
40 . . . detecting member
53 . . . groove portion (deformation regulating portion of detecting member)
60 . . . second housing

The invention claimed is:

1. A connector, comprising:

a first housing having a terminal accommodating portion and a peripheral wall substantially surrounding the terminal accommodating portion;

a second housing connectable to the first housing;

a detecting member configured to detect a connected state of the first and second housings based on whether or not the detecting member moves along a moving direction from an initial position to a detection position in a space between the terminal accommodating portion and the peripheral wall;

an opening formed in the peripheral wall in a circumferential direction and configured to expose the detecting member to an outer peripheral side, the opening having opposed first and second side edges extending substantially parallel to the moving direction of the detector and spaced from one another by an opening width;

first and second deformation regulating ribs formed on the peripheral wall at locations adjacent the first and second side edges of the opening, the ribs extending substantially parallel to the moving direction of the detecting member and projecting out from an external surface of the peripheral wall in directions substantially normal to the moving direction and to the width direction; and first and second deformation regulating grooves formed in the detecting member and configured to slidably engage the respective first and second deformation regulating ribs to permit movements of the detecting member along the moving direction between the initial position and the detecting position, the first and second deformation regulating grooves further sandwiching the respective first and second deformation regulating ribs from opposite sides in the width direction to regulate such deformation of the peripheral wall that would enlarge the opening width of the opening and to sandwich areas of the peripheral wall from inner and outer peripheral sides adjacent the opening.

2. A connector according to claim 1, wherein:

a lock arm configured to lock the first and second housings in the connected state is arranged between the terminal accommodating portion and the peripheral wall portion; and the detecting member and the lock arm at least partly overlap in an arrangement direction of the terminal accommodating portion and the lock arm.

3. The connector of claim 1, wherein the detecting member has a width in the width direction that is less than a width of the first housing in the width direction.

4. The connector of claim 1, further comprising springs for urging the detecting member toward the detecting position, the springs being in word of the peripheral wall of the first housing.

5. A connector, comprising:

a first housing having a terminal accommodating portion and a peripheral wall substantially surrounding the terminal accommodating portion, the peripheral wall having an inner peripheral surface facing the terminal accommodating portion and an outer peripheral surface opposite the inner peripheral surface, an opening formed in the peripheral wall, the opening having opposed first and second side edges extending parallel to a connecting direction of the first housing and spaced from one another in a width direction normal to the connecting direction by an opening width, first and second deformation regulating ribs formed on the peripheral wall at locations adjacent to and parallel to the respective first and second side edges of the opening, the ribs projecting out from the outer peripheral surface of the peripheral wall;

a second housing connectable to the first housing along the connecting direction;

a detecting member configured to detect a connected state of the first and second housings based on whether the detecting member moves along the connecting direction from an initial position to a detection position in a space between the terminal accommodating portion and the peripheral wall, first and second deformation regulating grooves formed in the detecting member and slidably engaging the respective first and second deformation regulating ribs to permit movement of the detecting member along the connecting direction between the initial position and the detecting position, the first and second deformation regulating grooves further sandwiching the respective first and second deformation regulating ribs from opposite sides in the width direction to regulate deformation of the peripheral wall that would enlarge the opening width of the opening and to sandwich areas of the peripheral wall from the inner and outer peripheral surfaces adjacent the opening.

6. The connector of claim 5, wherein the detecting member has a width in the width direction that is less than a width of the first housing in the width direction.

7. The connector of claim 5, further comprising springs for urging the detecting member toward the detecting position, the springs being in word of the peripheral wall of the first housing.

* * * * *